US007036668B2

(12) United States Patent
Udy

(10) Patent No.: US 7,036,668 B2
(45) Date of Patent: May 2, 2006

(54) TOOL HOLDER AND METHOD

(75) Inventor: David B. Udy, Salt Lake City, UT (US)

(73) Assignee: HandiSolutions, Inc., Salt Lake City, UT (US)

( * ) Notice: Subject to any disclaimer, the term of this patent is extended or adjusted under 35 U.S.C. 154(b) by 81 days.

(21) Appl. No.: 10/648,581

(22) Filed: Aug. 25, 2003

(65) Prior Publication Data

US 2004/0035732 A1 Feb. 26, 2004

Related U.S. Application Data

(60) Provisional application No. 60/406,083, filed on Aug. 26, 2002.

(51) Int. Cl.
*A47F 7/00* (2006.01)

(52) U.S. Cl. ..... 211/70.6; 211/60.1

(58) Field of Classification Search ..... 211/70.6, 211/60.1, 71.01, 70.8, 85.18, 189, 87.01, 211/68

See application file for complete search history.

(56) References Cited

U.S. PATENT DOCUMENTS

| | | | | |
|---|---|---|---|---|
| 118,451 | A | 8/1871 | Harris | |
| 1,733,868 | A | 10/1929 | Durell | |
| D169,077 | S | 3/1953 | Mains, Jr. | |
| 2,815,863 | A | 12/1957 | Larson | |
| 2,835,503 | A | 5/1958 | Humphries, et al. | |
| D185,807 | S * | 8/1959 | Antle | D22/107 |
| 3,298,531 | A | 1/1967 | Wilcke | |
| 3,298,532 | A | 1/1967 | Wilcke | |
| 3,731,333 | A | 5/1973 | Davis | |
| 3,745,702 | A | 7/1973 | Ogawa | |
| 3,759,538 | A | 9/1973 | Fabiano | |
| 4,450,967 | A * | 5/1984 | Castro | 211/85.7 |
| 4,947,998 | A | 8/1990 | Smeller | |
| 5,087,012 | A * | 2/1992 | Doublet | 248/512 |
| 5,092,463 | A | 3/1992 | Dees | |
| 5,129,528 | A | 7/1992 | Eidsmoe et al. | |
| 5,244,700 | A * | 9/1993 | Banschick | 428/4 |
| 5,350,065 | A | 9/1994 | Darrey | |
| 5,390,944 | A | 2/1995 | Sherwin | |
| 5,411,191 | A | 5/1995 | Bunn, Jr. | |
| 5,495,954 | A | 3/1996 | Schmit | |
| 5,544,764 | A | 8/1996 | Cima | |

(Continued)

*Primary Examiner*—Jennifer E. Novosad
(74) *Attorney, Agent, or Firm*—Starkweather & Associates; Michael W. Starkweather; Jason P. Webb

(57) ABSTRACT

A storage device for compactly storing elongate tools includes a plurality of receptacles arranged in a support in at least front and rear substantially linear rows. Each receptacle includes at least a lower receiving port and an upper receiving aperture in which a tool can be held when disposed through the upper receiving aperture and into the lower receiving port. The receptacles of the front row are forwardly splayed at a forward angle with respect to vertical greater than the receptacles of the rear row. The receptacles within each row are laterally splayed with respect to vertical, with receptacles within each row being oriented at progressively increasing lateral angles with respect to vertical from receptacles at a center to receptacles at lateral ends of each row.

37 Claims, 6 Drawing Sheets

U.S. PATENT DOCUMENTS 5,704,496 A 1/1998 Latta
5,755,325 A * 5/1998 Willhite et al. ..... 206/443
5,788,092 A 8/1998 Teeney
5,810,177 A 9/1998 Cabiran
5,823,363 A * 10/1998 Cassel ..... 211/60.1
5,971,333 A 10/1999 Fiedor
6,041,947 A 3/2000 Heneveld
D429,071 S 8/2000 Hurt
6,105,768 A 8/2000 Brown
6,142,320 A 11/2000 DeLorean et al.
6,530,487 B1 * 3/2003 Berry ..... 211/70.6

* cited by examiner

TOOL HOLDER AND METHOD

This Application claims benefit of U.S. Provisional Application No. 60/406,083, filed Aug. 26, 2002.

BACKGROUND OF THE INVENTION

1. Field of the Invention

The present invention relates generally to a tool holder and method for holding tools with elongated handles, such as gardening, lawn tools, cleaning tools and the like.

2. Related Art

Storage of elongate tools such as shovels and rakes often proves problematic due to the relatively large size of the tools. Such tools are often stored in garages, sheds or parking areas so as to be easily accessible when required for outdoor work. These type of lawn and garden tools typically include an elongate handle to which an implement is attached, and can include shovels, lawn rakes, leaf rakes, hoes, claws, pick axes, etc. Oftentimes, other types of tools are stored with lawn and garden tools due to their similar configuration. For example, cleaning tools such as brooms and mops are often stored in a garage or shed due to their elongate nature, even though the cleaning tools may be used primarily indoors.

Storage of these types of elongate tools is problematic in that the tools are generally "end-heavy," that is, most of the weight of the tool is centered at the end of the elongate handle where the shovel head, broom head, etc., is attached to the handle. These types of elongate tools can be stored in a number of manners, with perhaps the most commonly used method being placing the tool on the floor and leaning it against the wall. One disadvantage of this type of storage is that the tools are relatively vulnerable to being inadvertently contacted, and can easily tip or fall onto the floor. Falling tools can cause injuries to people and pets, and can cause damage to property, such as to vehicles parked in a garage. As an example, a user may reach for one tool and, while pulling it away from a group of tools, knock over another tool which may injure the user and/or cause damage to nearby property.

In an effort to avoid these problems, various types of storage systems have been developed for elongate tools. For example, a number of hooks or other holding devices can be secured to various locations along a wall of a garage or other structure. Each different tool can then be secured to its own hook or holding device along the wall. While the tools can be relatively well organized with this type of system, one disadvantage of this type of storage system is that it requires a large surface area to store a multitude of tools. For instance, it is common for the tools in such a system to occupy an entire wall of the garage. In addition, it is sometimes possible for the tools to become unsecured and fall, resulting in injury and/or damage.

Other systems devised include storing the tools in a large container, such as a garbage can or large pail. While this results in a centralized storage system with all tools stored in one area, one disadvantage of this system is that it is difficult to retrieve the tools from the container, as the plurality of tools often become inter-tangled with each other. In addition, such containers are often relatively tall, and shorter-handled tools can be difficult to see and/or retrieve.

Also, in order to remove a tool from the container, the tool must generally be lifted several feet into the air until the lowermost portion of the tool handle clears the container. This can result in the top of the tool contacting the roof of the garage or other structure and may also contact other objects. In may even be necessary to tilt or otherwise manipulate the container in order to identify and locate the desired tool, lift the tool out of the container, and simultaneously avoid contacting the roof of the structure and other objects. Thus, such storage systems generally require a large amount of open space above and around the container to enable storage and retrieval of elongate tools. In structures such as garages and sheds, there may not be sufficient open space above and around a container to effectively utilize such containers.

SUMMARY OF THE INVENTION

It has been recognized that it would be advantageous to develop a method and device for securely storing elongate tools that securely and compactly stores the tools in a centralized location yet enables easy identification, insertion and removal of the tools from the system.

The invention provides a storage device for securely and compactly storing elongate tools, and includes a plurality of receptacles arranged in a support in at least front and rear substantially linear rows. Each receptacle can include at least a lower receiving port and an upper receiving aperture in which a tool can be held when disposed through the upper receiving aperture and into the lower receiving port. The receptacles of the front row can be forwardly splayed at a forward angle with respect to vertical greater than the receptacles of the rear row. In addition, the receptacles within each row can be laterally splayed with respect to vertical, with receptacles within each row being oriented at progressively increasing lateral angles with respect to vertical from receptacles at a center of the row to receptacles at lateral ends of each row. Attachment means can be provided for attaching the support to a structure to secure the support in a stable configuration.

In accordance with a more detailed aspect of the present invention, the support can include an upper and a lower frame, the upper frame being associated with the upper receiving apertures and the lower frame being associated with the lower receiving ports.

In accordance with a more detailed aspect of the present invention, the support can include a rear contact surface configured to be disposed adjacent the structure, and an indentation in the rear contact surface to provide a space to enable the storage device to be attached flush with the structure over an abutment protruding from the structure.

In accordance with a more detailed aspect of the present invention, each receptacle can include a storage tube extending between the upper receiving aperture and the lower receiving port of the receptacle.

In accordance with a more detailed aspect of the present invention, each tube can include a bendable tab formed in each end of the tube. Each tab can have at least two configurations; an engaged position, in which the tab is engaged with the support; and a disengaged position, in which the tab is disengaged from the support.

In accordance with a more detailed aspect of the present invention, the support can comprise a tapered enclosure having side walls that taper inwardly in both frontal and lateral directions from a top of the enclosure to a bottom of the enclosure. A plurality of storage tubes can be disposed in the tapered enclosure, each storage tube being coupled between an upper receiving aperture and a lower receiving port of a receptacle.

In accordance with a more detailed aspect of the present invention, the receptacles can have a height less than about 12 inches; at least five receptacles can be disposed within a row having a total width less than about 15 inches; and at least two of the rows of receptacles can be disposed within a space having a depth less than about 7 inches.

In accordance with a more detailed aspect of the present invention the support is attached to an enclosure having a ceiling height of less than about 8 feet.

In accordance with a more detailed aspect of the present invention, at least one auxiliary collar can extend laterally with respect to the support and can be configured to receive and store an auxiliary item therein. At least one divider can be removably insertable into the auxiliary collar to provide support to an auxiliary item disposed in the collar.

In accordance with a more detailed aspect of the present invention, a receiving slot can be associated with the support and can be sized and shaped to receive and store the divider when the divider is not inserted into the auxiliary collar.

In accordance with a more detailed aspect of the present invention, the receptacles of the rear row can be forwardly splayed at a forward angle with respect to vertical.

In accordance with a more detailed aspect of the present invention, the lower receiving ports of the rear row can have an elevation greater than the lower receiving ports of the front row, to provide elevated storage of elongate tools disposed in the receptacles of the rear row In accordance with a more detailed aspect of the present invention, a reinforcing plate can be coupled beneath the receptacles of the front row to the provide support to elongate tools disposed in the receptacles of the front row.

In accordance with a more detailed aspect of the present invention, at least one auxiliary container can be removably attached to the support to receive and store an auxiliary item therein.

In accordance with another aspect of the present invention, a method of compactly storing elongate tools adjacent to a structure is provided, and includes the steps of a) attaching a tool storage device to a lower section of the structure, the tool storage device having: i) a plurality of receptacles arranged in a support in at least front and rear substantially linear rows; ii) each receptacle including at least a lower receiving port and an upper receiving aperture; iii) the receptacles of the front row being forwardly splayed at a forward angle with respect to vertical greater than the receptacles of the rear row; and b) inserting a handle of each of a plurality of elongate tools into one of the receptacles such that the plurality of elongate tools are stored in the storage device in a splayed directional orientation.

In accordance with a more detailed aspect of the present invention the method includes the further step of attaching the tool storage device flush with the structure over an abutment projecting from the structure.

Additional features and advantages of the invention will be apparent from the detailed description which follows, taken in conjunction with the accompanying drawings, which together illustrate, by way of example, features of the invention.

DETAILED DESCRIPTION

Figure 1:
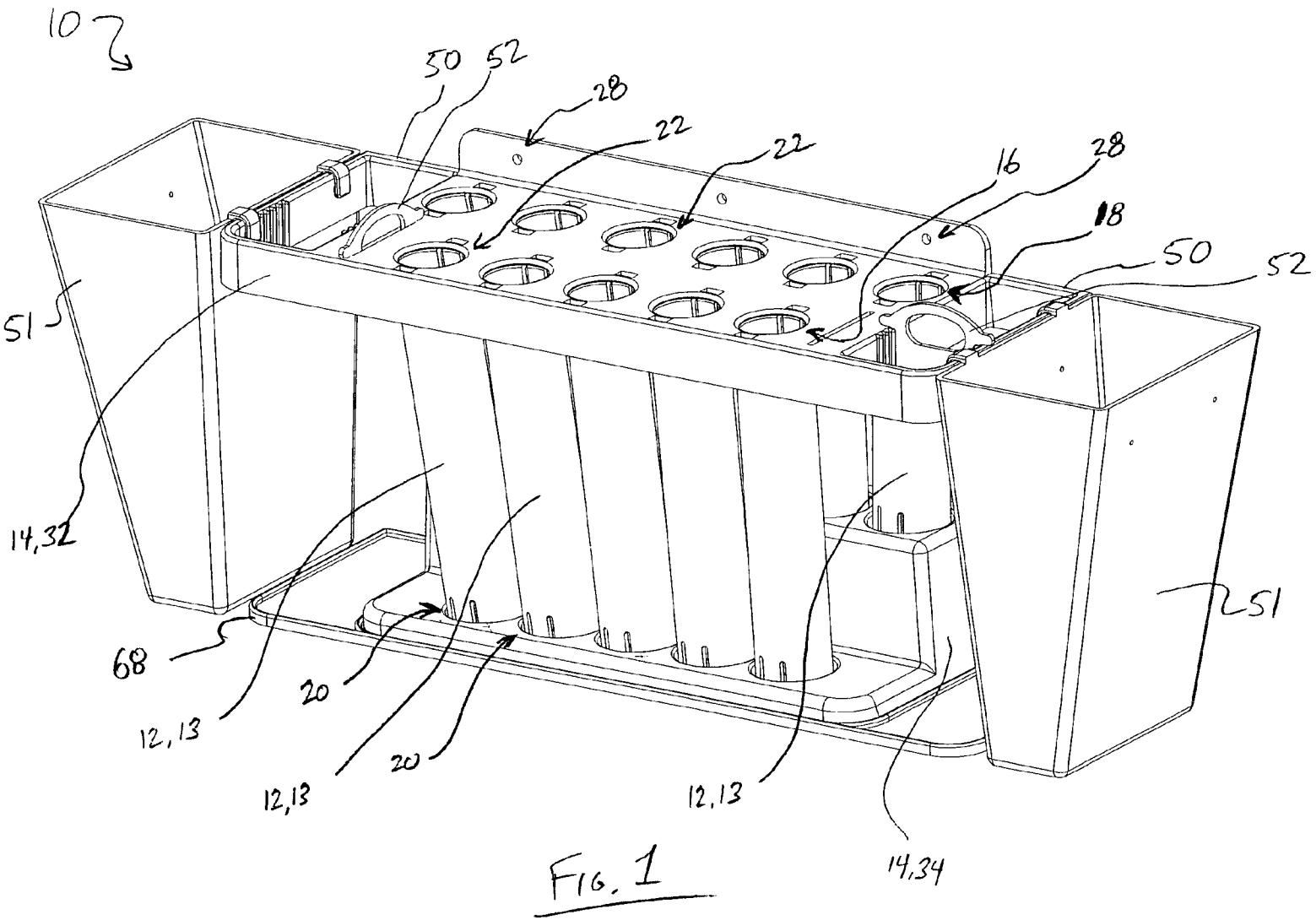
FIG. 1 is a perspective view of a tool storage device in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
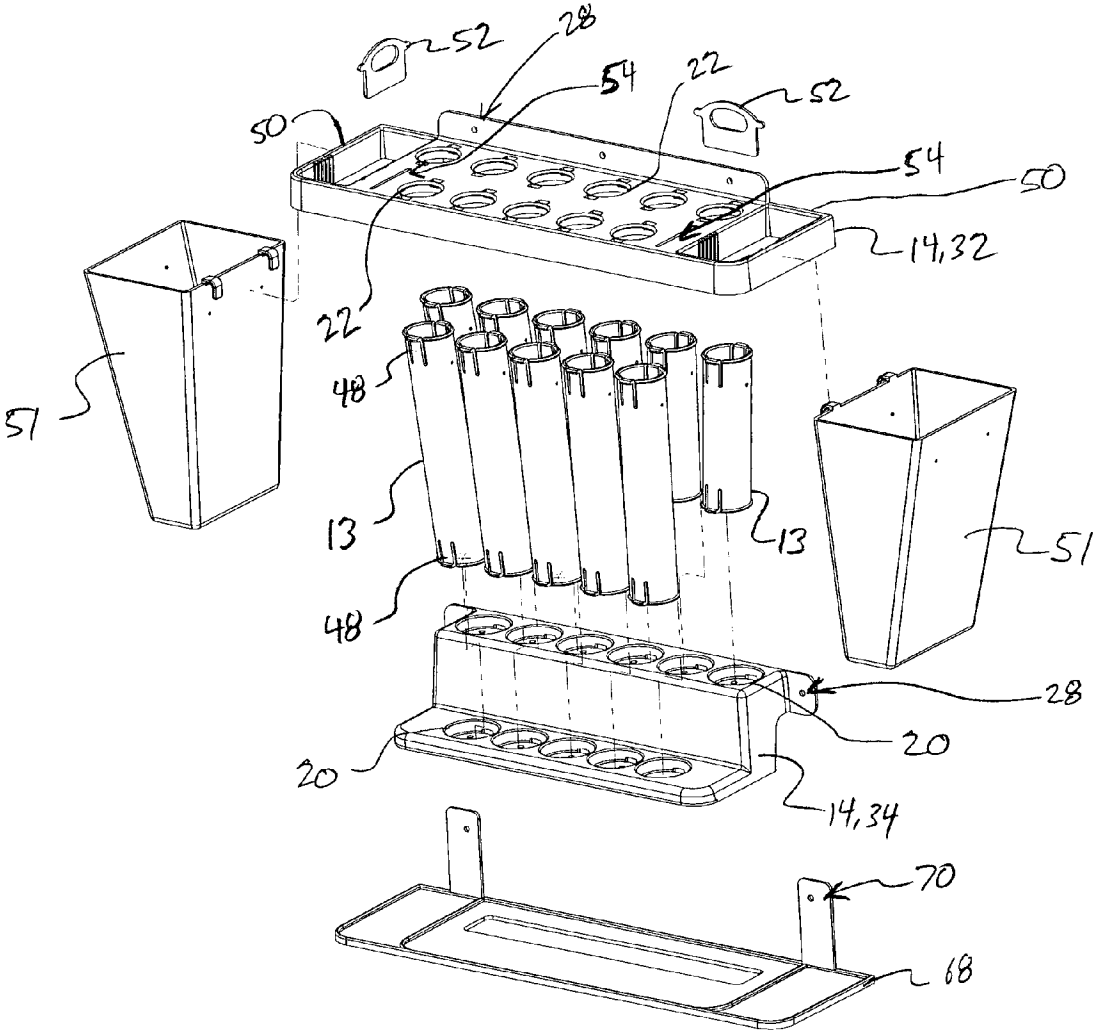
FIG. 2 is an exploded, perspective view of the tool storage device of FIG. 1.
Figure 3:
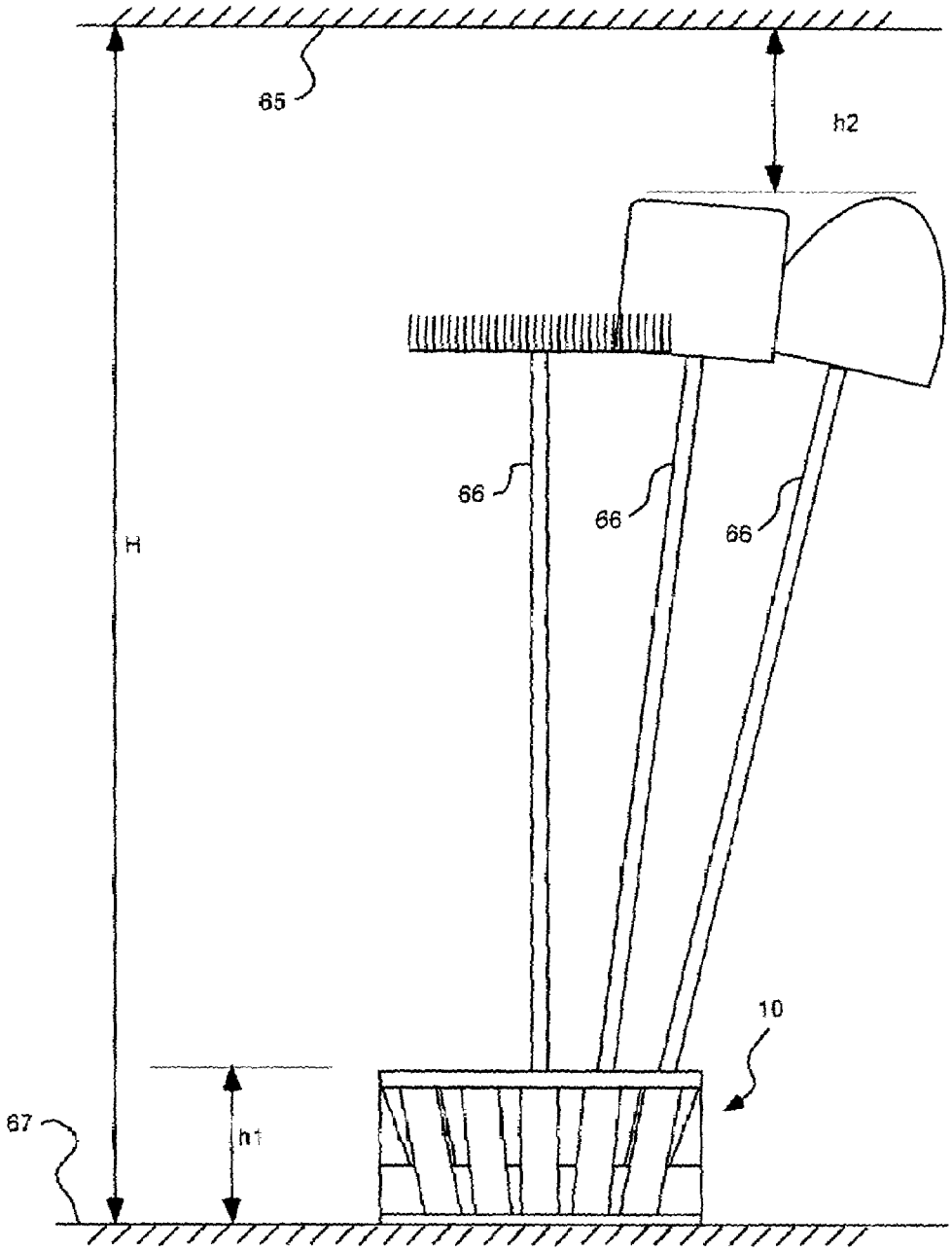
FIG. 3 is a front schematic view of the tool holder device of FIG. 1, as installed within a structure and with elongate tools stored therein.

As illustrated in FIGS. 1–3, a tool storage device, indicated generally at 10, is provided in accordance with the present invention. The tool storage device can be utilized to compactly store a plurality of elongate tools, such as shovels, rakes, broom, mops, etc. Such tools are generally "end heavy," in that they include a generally lightweight elongate handle to which a relatively heavy implement or tool head is attached on one end. The present invention can be used to compactly and securely store such tools in a manner that allows easy access to and retrieval of the tools while preventing the tools from falling or tipping and causing injury or damage. The tool storage device can advantageously be used in structures, such as garages and sheds, that do not generally possess high ceiling clearances. The storage device can also be used when attached to a door or other similar structure.

In accordance with one aspect of the invention, the storage device 10 can include a plurality of receptacles 12 which can be arranged in a support 14 in at least front 16 and rear 18 substantially linear rows. Each receptacle can include a lower receiving port 20 and an upper receiving aperture 22 in which a tool 66(FIG. 3) can be held when disposed through the upper receiving aperture 22 and into the lower receiving port 20. In addition, the receptacles 12 also can include a storage tube 13 extending between the upper receiving aperture 22 and the lower receiving port 20 of the receptacle. The storage tube 13 can help guide the tool as it is inserted and removed from the receptacle 12, and can resist the tool from becoming entangled with other tools, or misaligning with other receiving apertures 22. In order to store an elongate tool in the storage device, a user can insert an end of the tool, generally the handle end of the tool, through the receiving aperture 22, along the storage tube 13, and into the receiving port 20. The tool is then held securely by the storage device and the tool head end of the tool is separated from adjacent tool heads to facilitate easy identification, insertion and removal of tools from the storage device.

While shown in the figures and described herein as at times including a storage tube 13, it is understood that, as used herein, the term "receptacle" 12 is not limited to a tube-like structure, or to a continuous structure. In one aspect of the invention, the receptacle is comprised only of an upper receiving aperture 22 and a lower receiving port 20. Once disposed in the receptacle, an elongate tool is held securely by the receiving aperture and port 22 and 20 without requiring the presence of additional structure between the two. Similarly, the term "tube" or "storage tube" is not limited to a component having a tubular cross-section, but can include a component with a square, triangular, or other cross-sectional shape. In addition, the tube 13 itself can form the upper receiving aperture 22 and the lower receiving port 20.

Figure 4:
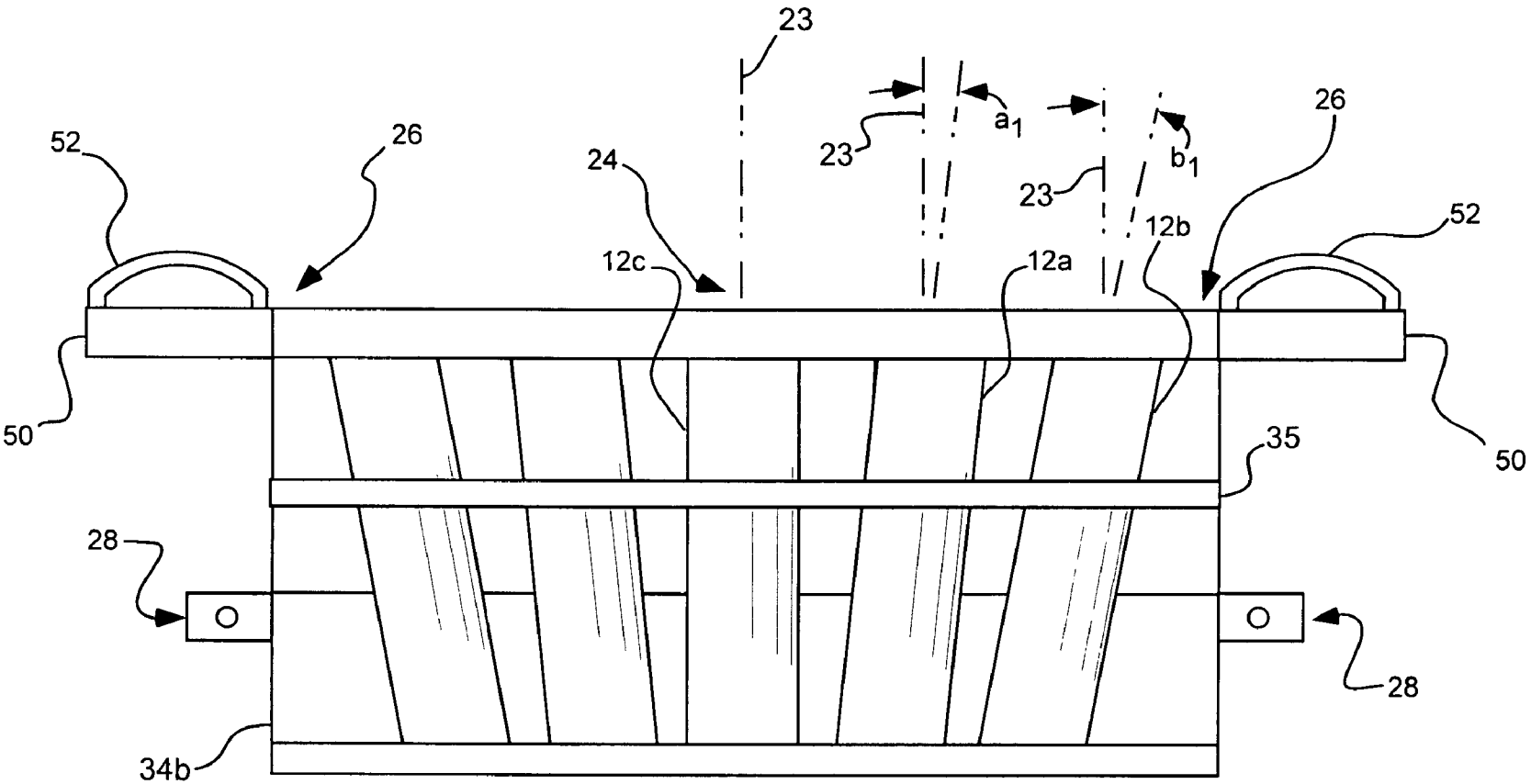
FIG. 4 is a front schematic view of a tool storage device in accordance with an embodiment of the invention.
Figure 5:
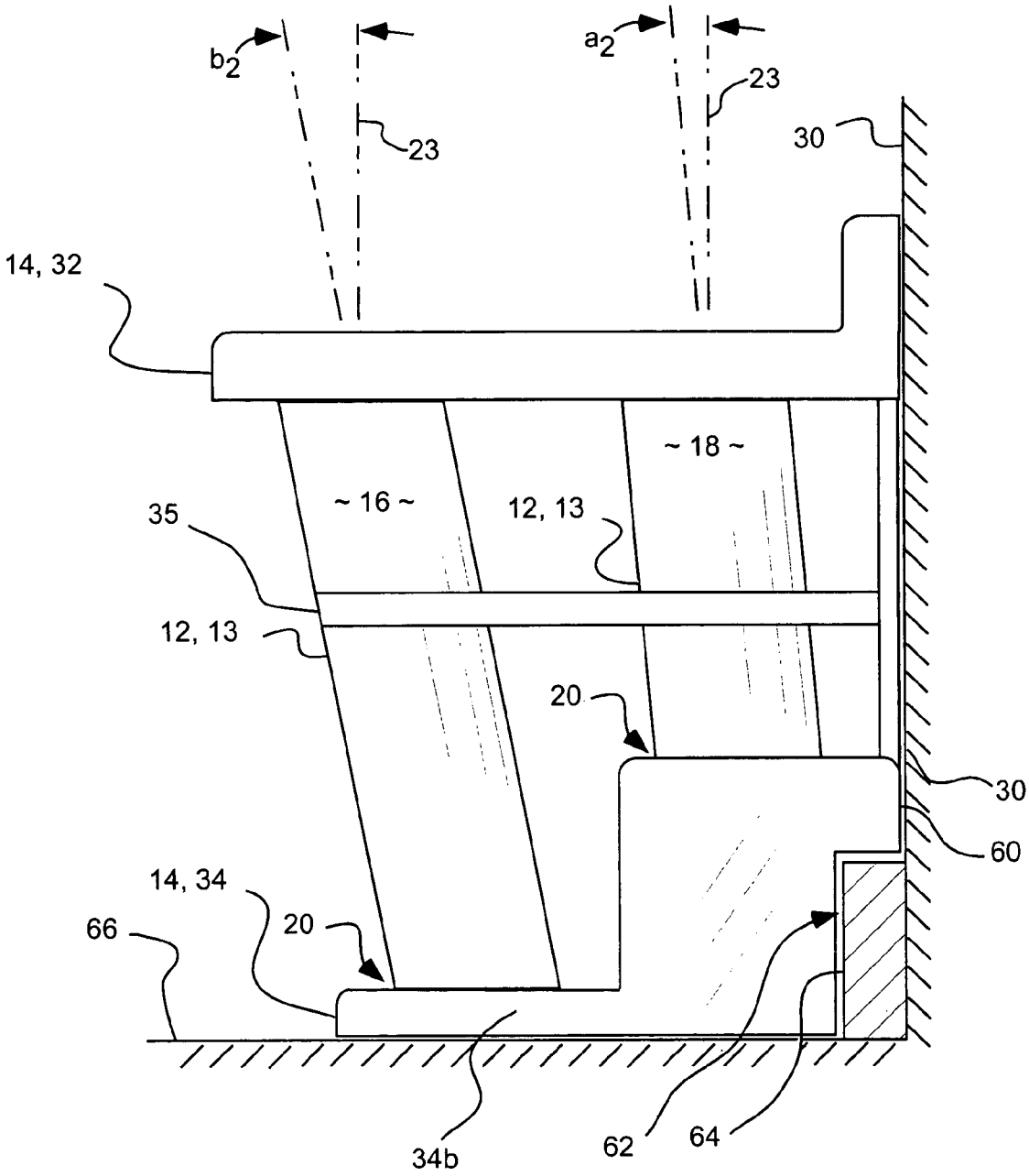
FIG. 5 is a side schematic view of the tool storage device of FIG. 4.

Referring to FIGS. 4 and 5, the receptacles 12 of each row 16 and 18 can be forwardly splayed with respect to the receptacles of remaining rows, or the rows 16 and 18 can be forwardly splayed with respect to one another, as best illustrated in FIG. 5. The receptacles of the front row 16 can be oriented at a forward angle $b_2$ with respect to vertical 23 greater than a forward angle $a_2$ of the receptacles of the rear row 18. In this manner, tools held in the receptacles of each row are angularly splayed from tools held in adjacent rows, to provide for separation of the tool head ends of the elongate tools. While both rows 16 and 18 are shown in FIG. 5 as being slanted forwardly with respect to vertical, in one aspect of the invention the rear row may be oriented in a substantially upright vertical angle, with little or no deviation from vertical.

In addition to forwardly splayed rows of receptacles, the receptacles 12 within each row 16 and 18 can be laterally splayed with respect to vertical 23, as best shown in FIG. 4. Receptacles 12 within each row can be oriented at progressively increasing lateral angles with respect to vertical 23 from receptacles at a center 24 of the row, to receptacles at lateral ends 26 of the row. For example, a center or first receptacle 12*c* can be oriented laterally at a generally vertically angle, while an adjacent or second receptacle 12*a* can be slanted or laterally angled from vertical 23 by a first angle $a_1$. Similarly, a subsequent or third receptacle 12*b* can be slanted from vertical 23 by a second angle $b_1$, which is greater than the first angle $a_1$, or greater than the lateral angle of the second receptacle 12*a*. Thus, the receptacles within a row can be laterally splayed at progressively increasing lateral angles.

The storage device 10 advantageously provides compact tool storage and securely holds elongate tools while providing forwardly and laterally splayed separation of the tool head ends of the tools to allow the tools to be easily identified, removed and stored in the storage device. Due to the relatively bulky nature of the tool heads of many elongate tools, the tools can easily become inter-tangled or intermeshed when stored in close proximity to each other. It is for this reason that conventional container storage systems, such as large buckets or pails, have proved problematic. In such systems, the tools become tangled and it becomes difficult to remove a single tool as the tool must first be disentangled from neighboring tools. In contrast, the present invention maintains separation of the tool head ends of the tools to enable easy insertion and removal of individual tools.

Because elongate tools are stored in the storage device at varying degrees of angular tilt from vertical, the tools can tend to apply a moment to the tool storage device, as most of the weight of the tool is concentrated at the tool head end of the tool. To counteract this moment force, the tool holder advantageously includes attachment means 28 for attaching the support 14 to a structure 30 (FIGS. 5 and 6) to secure the support 14 in a stable configuration. The tool storage device can be attached to a variety of structures including sheds, garages, homes, doors, gates, etc. In one aspect of the invention, the storage device is attached to an openable door of a structure such as a shed or garage, and the tools are exposed to a user when the door is in the open position. In this manner, a large number of tools can be stored within the shed or garage and are effectively removed from the space inside the shed or garage upon opening of the door.

Figure 6:
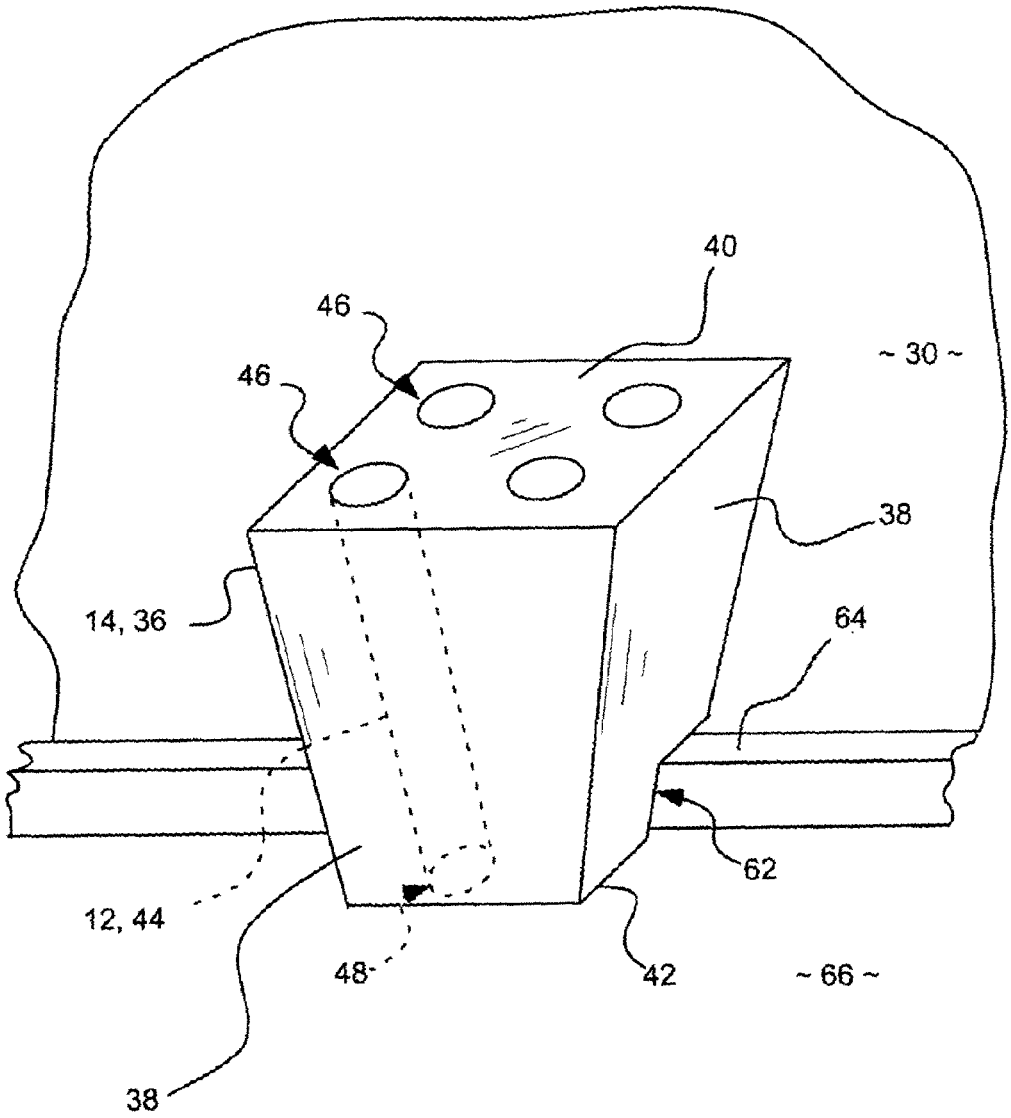
FIG. 6 is a perspective view of another tool storage device in accordance with an embodiment of the invention.

The support 14 can be of a variety of configurations, and can include an upper frame 32 and a lower frame 34. The upper frame 32 can be associated with, contain, or be coupled to the upper receiving apertures 22, and the lower frame 34 can be associated with, contain, or be coupled to the lower receiving ports 20. For example, the receiving apertures 22 can be formed in the upper frame 32, while the receiving ports 20 can be formed in the lower frame 34. Referring to FIGS. 4 and 5, the support 14 can include an upper frame 32, a lower plate 34*b*, and a band 35. The tubes 13 can be held by the upper frame 32, and can rest on the lower plate 34*b*. The band 35 can extend around the tubes 13 and hold the tubes together, or can maintain the tubes on the lower plate. Referring to FIG. 6, the support 14 can include a tapered enclosure 36 having side walls 38 that taper inwardly in both frontal and lateral directions from a top 40 of the enclosure to a bottom 42 of the enclosure. In this aspect, a plurality of storage tubes 44 can disposed in the tapered enclosure, with each storage tube forming an upper receiving aperture 46 and a lower receiving port 48 of a receptacle 12.

Referring again to FIG. 2, the plurality of storage tubes 13 can each include a bendable tab 48 formed in each end of the tube to facilitate coupling of the tube to the support 14 or to the frames 32 and 34. Each bendable tab 48 can have at least two configurations, an engaged position, in which the tab 48 engages with the support or frame, and a disengaged position, in which the tab is disengaged from the support or frame. In this manner, the tubes can be secured to the support, or to the upper and lower frames. In addition, the tabs can allow the tubes to be temporarily or removably inserted and engaged into the support or frame. Alternatively, the tubes can be integrally formed with the support or frame, or can be bonded or otherwise attached or coupled to the support or frame, as would occur to one skilled in the relevant art.

The storage device can also include at least one auxiliary collar 50 which can extend laterally from the support 14 or upper frame 32 and can be configured to receive and store an auxiliary item (not shown) therein. The auxiliary item can be any item or tool that can benefit from proximal storage to the elongate tools stored in the device, including small garden shovels, axe handles, tools with "gripper" handles, etc. In addition, at least one divider 52 can be removably insertable into the auxiliary collar 50 to provide support to the auxiliary item disposed in the collar. The divider 52 can be selectively disposed along a plurality of slots or grooves formed on opposite sides of the collar 50.

Because auxiliary items of varying shapes and sizes may be stored in the collar 50, the removable divider 52 can be used to secure, or "wedge" an auxiliary item within the collar to aid in maintaining the item within the collar. Also, as discussed further below, in one aspect of the invention the storage device is attached to a movable door, and the removable divider can restrain the auxiliary item from falling from the storage device while the device is moving with the door. In addition, auxiliary containers 51 can be removably attachable to the support 14 or frame 32 and 34 to provide storage for additional auxiliary items or devices.

A receiving slot 54 can be associated with the support 12 or frames 32 and 34 and can be sized and shaped to receive and store the divider 52 when the divider is not inserted into the auxiliary collar. In this manner, when the divider 52 is not in use, for instance when an auxiliary item of a large size is stored in the collar 50, the divider 52 can be safely stored in the receiving slot 54 so as not to become misplaced or lost.

As illustrated in FIG. 5, the support 14, lower plate 34*b*, or lower frame 34 (FIGS. 1 and 2) can include a rear contact surface 60 disposed adjacent the structure 30. An indentation 62 can be included in the rear contact surface 60 to provide a space to enable the storage device to be attached flush with the structure 30 over an abutment 64 protruding from the structure. The feature is advantageous in cases where the storage device is attached to a structure, such as a garage or shed, that includes a footing, baseboard or molding protruding from the wall of the structure. In this case, attachment of the storage device can be accomplished by disposing the indentation 62 over the footing and mounting the storage device flush with the wall of the structure.

The storage device is configured to provide compact storage of a plurality of elongate tools. To accomplish this, the storage device can be formed to consume a relatively minimal amount of space while still providing storage for a large number of tools. In one aspect of the invention, the receptacles can have a height h1 (FIG. 3) less than about 12 inches. Also, at least five receptacles can be disposed within a row having a total width less than about 15 inches. At least two of the rows of receptacles can be disposed within a space having a depth less than about 7 inches. In this manner the storage device consumes a relatively small "footprint" as compared with many conventional storage devices for use with a plurality of tools. The compact storage will be appreciated by those desiring to store a number of elongate tools while conserving additional storage space within a structure. The receptacles or tubes can have a diameter of approximately 2 inches.

The compact nature of the storage device can perhaps be best appreciated by viewing FIG. 3. In this embodiment, the storage device 10 is attached within a structure that comprises an enclosure having a relatively low ceiling height H, on the order of less than about 8 feet. Various elongate tools 66 can be disposed in the storage device. As will be appreciated by those skilled in the art, storing elongate tools in a generally upright orientation within an enclosure dictates that the elongate tools cannot be moved a great vertical distance. For this reason, large barrels, such as 55-gallon drums, are not suitable for use in low-ceiling enclosures because storage of an elongate tool within the barrel would require that the tool be lifted several feet into the air to be placed into and removed from the barrel. The tool must be lifted in order to have sufficient vertical clearance to "clear" the sides of the barrel.

Because of the advantageously low footprint of the present invention, the storage device can be used in enclosures having low ceiling height and small vertical clearance. As shown in FIG. 3, the total height H from floor 67 to ceiling 65 of a structure can be on the order of 8 feet, and may be as little as 6 feet. Compact, upright storage of elongate tools with a height on the order of 5½ feet in such structures has conventionally proved difficult because of the minimal vertical clearance available for lifting and storing the tools in a container. Because of the compact footprint of the present invention, a height $h_1$ of the storage device can be made small enough such that sufficient clearance $h_2$ is provided to enable the tools to be lifted above and disposed within the storage device without contacting the ceiling 65 of the structure.

As shown in FIG. 5, in one aspect of the invention, the lower receiving ports 20, or bottoms of the receptacles or tubes, of the rear row 18 can have an elevation greater than the lower receiving ports 20 of the front row 16. Thus, the receptacles 12 or tubes 13 of the rear row 18 are disposed at a higher elevation than the receptacles 12 or tubes 13 of the front row 16. In this manner, the storage device can provide elevated storage of elongate tools disposed in the receptacles of the rear row. Thus, in addition to separating the tool head ends of the elongate tools in a forwardly and laterally splayed configuration, the tool head ends of the elongate tools disposed in the rear row can also be separated vertically, or splayed vertically, from tools with similar lengths stored in the front row of receptacles. The tool head ends of the tools in the rear row can thus be visible and accessible behind the tool head ends of the tools in the front row.

While in some applications the tool storage device can be disposed on a floor 66 of a structure, as shown in FIG. 5, the storage device can be installed in a number of advantageous locations. In one aspect, the structure 30 to which the storage device is attached can be a openable door, in which case there is generally no floor or bottom structure on which to rest the bottom of the storage device to provide support to tools stored in the front row 16 of the storage device. In this case, a reinforcing plate 68 (FIGS. 1 and 2) can be coupled beneath the receptacles of the front row to provide support to elongate tools disposed in the receptacles of the front row. The reinforcing plate can include attachment means 70 that can be aligned with the attachment means 28 of the support 14 or frame 34 to facilitate attachment of the reinforcing plate to the structure.

The present invention also provides a method compactly of storing elongate tools adjacent a structure. The method can include the steps of attaching a tool storage device having structure described above to a lower section of the structure, and inserting a handle of each of a plurality of elongate tools into a receptacle, such that the plurality of elongate tools are stored in the storage device in a splayed directional orientation. The method can include the further step of attaching the tool storage device flush with the structure over an abutment projecting from the structure. The structure utilized in the method can include a variety of structures, including an openable door.

The support 14 or frames 32 and 34 described above can be formed of ABS plastic, and can be formed by injection molding. Similarly, the tubes 13 can be formed of ABS plastic, and also can be formed by injection molding. The tubes 13 of each row 16 or 18 can be molded together in a single mold. In addition, the tubes of each row can be molded with connecting arms connecting adjacent tubes. The tubes can be assembled to the frames by inserting the ends of the tubes into the receiving ports 20 of the lower frame 34, and inserting the upper ends of the tubes into the receiving apertures 22 of the upper frame 32. The connecting arms can attach the tubes of a row together so that the row of tubes can be easily handled, and can be assembled as a single piece. In addition, the connecting arms can be flexible to allow the tubes to be angled or splayed with respect to one another. The tabs on the tubes can extend through holes, or into cavities, formed in the frames. In addition, the tabs can include notches or protrusions that engage the edges of the holes, or notches or protrusions in the cavities. The tubes can also be solvent welded to the frames. The tubes, support, frames, and other structure of the present invention can be formed of a variety of materials, including polymers, metals, composite materials, etc.

The attachment means 28 and 70 described above can include fasteners extending through apertures in the support 14 and into the structure. The fasteners can include screws, bolts, nails, rivets, etc. In addition the attachment means can also include adhesive, hook-and-loop type fasteners, etc.

Although the above devices have been described with respect to two rows, or front and rear rows, multiple rows can be provided, such as three rows. In addition, the rows are substantially linear, or substantially straight, although the receptacles in each row may be aligned along a broad curvature, or may alternate positions back-and-forth slightly. Furthermore, the rows have been described as having five or six receptacles, although any number of receptacles can be provided.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A storage device for compactly storing elongate tools, comprising:

a) a plurality of receptacles arranged in a support in at least front and rear substantially linear rows;

b) each receptacle including at least a lower receiving port and an upper receiving aperture in which a tool can be held when disposed through the upper receiving aperture and into the lower receiving port;

c) the receptacles of the front row being forwardly splayed at a forward angle with respect to vertical greater than the receptacles of the rear row;

d) the receptacles within each row being laterally splayed with respect to vertical, with receptacles within each row being oriented at progressively increasing lateral angles with respect to vertical from receptacles at a center of each row to receptacles at lateral ends of each row;

e) attachment means for attaching the support to a structure to secure the support in a stable configuration; and f) wherein the support includes a rear contact surface configured to be disposed adjacent the structure and an indentation in the rear contact surface to provide a space to enable the storage device to be attached flush with the structure over an abutment protruding from the structure.

2. The storage device of claim 1, wherein the support includes an upper frame and a lower frame, the upper frame being associated with the upper receiving apertures and the lower frame being associated with the lower receiving ports.

3. The storage device of claim 1, wherein each receptacle further includes a storage tube extending between the upper receiving aperture and the lower receiving port of the receptacle.

4. The storage device of claim 3, wherein each tube includes a bendable tab formed in each end of the tube, each tab having at least two configurations:

i) an engaged position, in which the tab is engaged with the support; and ii) a disengaged position, in which the tab is disengaged from the support.

5. The storage device of claim 3, wherein die support further includes a band extending around the plurality of tubes.

6. The storage device of claim 1, wherein:

i) the receptacles have a height less than about 12 inches;

ii) at least five receptacles are disposed within a row having a total width less than about 15 inches; and iii) at least two of the rows of receptacles are disposed within a space having a depth less than about 7 inches.

7. The storage device of claim 6, wherein the support is attached to an enclosure having a ceiling height of less than about 8 feet.

8. The storage device of claim 1, further comprising:

i) at least one auxiliary collar extending laterally with respect to the support and being configured to receive and store an auxiliary item therein;

ii) at least one divider removably insertable into the auxiliary collar, to provide support to an auxiliary item disposed in the collar.

9. The storage device of claim 8, further comprising a receiving slot associated with the support and being sized and shaped to receive and store the divider when the divider is not inserted into the auxiliary collar.

10. The storage device of claim 1, wherein the receptacles of the rear row are each forwardly splayed at a forward angle with respect to vertical.

11. The storage device of claim 1, further comprising a reinforcing plate disposed beneath the receptacles to provide support to elongate tools disposed in the receptacles of the front row.

12. The storage device of claim 1, further comprising at least one auxiliary container removably attached to the support and being configured to receive and store an auxiliary item therein.

13. The storage device of claim 1, wherein the receptacles of the rear row are disposed at a higher elevation then the receptacles of the front row.

14. A storage device for compactly storing elongate tools, comprising:

a) a plurality of receptacles arranges in a support in at least front and rear substantially linear rows;

b) each receptacle including at least a lower receiving pod and an upper receiving aperture in which an elongate tool can be held when disposed through the upper receiving aperture and into the lower receiving port;

c) the receptacles of the front row being forwardly splayed at a forward angle with respect to vertical greater than the receptacles of the rear row;

d) the receptacles within each row being laterally splayed with respect to vertical, with receptacles within each row being oriented at progressively increasing lateral angles with respect to vertical from receptacles at a center of each row to receptacles at lateral ends of each row;

e) the lower receiving ports of the rear row having an elevation greater than the lower receiving ports of the front row, to provide elevated storage of elongate tools disposed in the receptacles of the rear row;

f) attachment means for attaching the support to a structure to secure the support in a stable configuration; and g) wherein each receptacle further includes a storage tube extending between the upper receiving aperture and the lower receiving port of the receptacle.

15. The storage device of claim 14, wherein the support includes an upper frame and a lower frame, the upper frame being associated with the upper receiving apertures and the lower frame being associated with the lower receiving ports.

16. The storage device of claim 14, wherein the support includes:

a rear contact surface to be disposed adjacent the structure; and an indentation in the rear contact surface to provide a space to enable the storage device to be attached flush with the structure over an abutment protruding from the structure.

17. The storage device of claim 14, wherein each tube includes a bendable tab formed in each end of the tube, each tab having at least two configurations:

i) en engaged position, in which the tab is engaged with the support; and ii) a disengaged position, in which the tab is disengaged from the support.

18. The storage device of claim 14, wherein the support further includes a band extending around the plurality of tubes.

19. The storage device of claim 14, wherein:

i) the receptacles have a height less than about 12 inches;

ii) at least five receptacles are disposed within a row having a total width less than about 15 inches; and iii) at least two of the rows of receptacles are disposed within a space having a depth less than about 7 inches.

20. The storage device of claim 19, wherein the support is attached to an enclosure having a ceiling height of less than about 6 feet.

21. The storage device of claim 14, further comprising:

i) at least one auxiliary collar extending laterally with respect to the support and being configured to receive and store an auxiliary item therein;

ii) at least one divider removably insertable into the auxiliary collar, to provide support to an auxiliary item disposed in the collar.

22. The storage device of claim 21, further comprising a receiving slot associated with the support and being sized and shaped to receive and store the divider when the divider is not inserted into the auxiliary collar.

23. The storage device of claim 14, wherein the receptacles of the rear row are each forwardly splayed at a forward angle with respect to vertical.

24. The storage device of claim 14, further comprising a reinforcing plate disposed beneath the receptacles to provide support to elongate tools disposed in the receptacles of the front row.

25. The storage device of claim 14, further comprising at least one auxiliary container removably attached to the support and being configured to receive and store an auxiliary item therein.

26. A method of compactly storing elongate tools adjacent a structure, comprising the steps of:

a) attaching a tool storage device to a lower section of the structure, the structure comprising an openable door, the tool storage device having:

i) a plurality of receptacles arranged in a support in at least front and rear substantially linear rows;

ii) each receptacle including at least a lower receiving port and an upper receiving aperture;

iii) the receptacles of the front row being forwardly splayed at a forward angle with respect to vertical greater than the receptacles of the rear row; and b) inserting a handle of each of a plurality of elongate tools into one of the receptacles such that the plurality of elongate tools are stored in the storage device in a splayed directional orientation.

27. The method of claim 26, comprising the further step of attaching the tools storage device flush with the structure over an abutment projecting from the structure.

28. The method of claim 26, wherein:

i) the receptacles have a height less than about 12 inches;

ii) at least five receptacles are disposed within a row having a total width less than about 15 inches; and iii) at least two of the rows of receptacles are disposed within a space having a depth less than about 7 inches.

29. The method of claim 28, wherein the structure comprises an enclosure with a ceiling height of less than about 6 feet.

30. The method of claim 26, wherein the receptacles of the rear row are disposed at a higher elevation than the receptacles of the front row.

31. The method of claim 30, comprising the further step of attaching a reinforcing plate beneath the receptacles of the front row to provide support to the elongate tools disposed in the receptacles of the front row.

32. The method of claim 26, wherein the receptacles within each row are laterally splayed with respect to vertical, with receptacles within each row being oriented at progressively increasing lateral angles with respect to vertical from receptacles at a center of the row to receptacles at lateral ends of each row.

33. A storage device for compactly storing elongate tools, comprising:

a) a plurality of receptacles arranged in a support in at least front and rear substantially linear rows;

b) each receptacle including at least a lower receiving port and an upper receiving aperture in which a tool can be held when disposed through the upper receiving aperture and into the lower receiving port;

c) the receptacles of the front row being forwardly splayed at a forward angle with respect to vertical greater than the receptacles of the rear row;

d) the receptacles within each row being laterally splayed with respect to vertical, with receptacles within each row being oriented at progressively increasing lateral angles with respect to vertical from receptacles at a center of each row to receptacles at lateral ends of each row;

e) attachment means for attaching the support to a structure to secure the support in a stable configuration;

f) at least one auxiliary collar extending laterally with respect to the support and being configured to receive and store an auxiliary item therein; and g) at least one divider removably insertable into the auxiliary collar, to provide support to an auxiliary item disposed in the collar.

34. The storage device of claim 33, further comprising a receiving slot associated with the support and being sized and shaped to receive and store the divider when the divider is not inserted into the auxiliary collar.

35. A storage device for compactly storing elongate tools, comprising:

a) a plurality of receptacles arranges in a support in at least front and rear substantially linear rows;

b) each receptacle including at least a lower receiving port and an upper receiving aperture in which an elongate tool can be held when disposed through the upper receiving aperture and into the lower receiving port;

c) the receptacles of the front row being forwardly splayed at a forward angle with respect to vertical greater than the receptacles of the rear row;

d) the lower receiving ports of the rear row having an elevation greater than the lower receiving ports of the front row, to provide elevated storage of elongate tools disposed in the receptacles of the rear row; and e) wherein the lower receiving ports of the rear row comprise an elevated bottom configured to provide elevated storage with respect to the receptacles of the front row.

36. The storage device of claim 35, further comprising a storage tube extending between an upper receiving aperture and an lower receiving port of the receptacle.

37. The storage device of claim 36, wherein each tube includes a bendable tab formed in each end of the tube, each tab having at least two configurations:

i) an engaged position, in which the tab is engaged with the support; and ii) a disengaged position, in which the tab is disengaged from the support.

* * * * *